United States Patent [19]

Popp et al.

[11] Patent Number: 4,567,014

[45] Date of Patent: Jan. 28, 1986

[54] CONTAINER FOR TRANSPORTING AND STORING NUCLEAR REACTOR FUEL ELEMENTS

[75] Inventors: Franz-Wolfgang Popp, Wedemark; Kurt Feuring, Solms, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 436,065

[22] Filed: Oct. 22, 1982

[30] Foreign Application Priority Data

Oct. 28, 1981 [DE] Fed. Rep. of Germany ..... 3142646

[51] Int. Cl.[4] ..... G21C 19/40

[52] U.S. Cl. ..... 376/272; 250/506.1; 228/184; 220/67; 220/83

[58] Field of Search ..... 376/272; 250/506.1, 250/507.1; 220/3, 5 A, 67, 83; 52/128-142; 164/98, 111, 76.1; 29/428, 462; 228/184, 60, 128

[56] References Cited

U.S. PATENT DOCUMENTS

| | | | |
|---|---|---|---|
| 3,178,811 | 4/1965 | Fuller | 220/67 X |
| 3,430,681 | 3/1969 | Smith et al. | 164/111 |
| 3,489,309 | 1/1970 | Berman et al. | 220/3 |
| 3,638,978 | 2/1972 | Gunterman | 164/111 X |
| 3,731,101 | 5/1973 | Peterson et al. | 376/272 X |
| 3,780,306 | 12/1973 | Anderson et al. | 376/272 X |
| 4,278,892 | 7/1981 | Boatz et al. | 250/506.1 |
| 4,330,711 | 5/1982 | Ahner et al. | 250/506.1 |
| 4,341,557 | 7/1982 | Lizenby | 75/223 |
| 4,349,991 | 9/1982 | Schwaers et al. | 220/3 X |

FOREIGN PATENT DOCUMENTS

| | | | |
|---|---|---|---|
| 0036961 | 10/1981 | European Pat. Off. | 250/506.1 |
| 7737499 | 12/1977 | Fed. Rep. of Germany . | |
| 2024694 | 1/1980 | United Kingdom | 376/272 |

OTHER PUBLICATIONS

Lexikon der Technik, pp. 642-647, vol. 3, Lueger.

Article entitled "Verband Von Stahl, Metallen BZW, Deren Legierungen Mit FE-C-GUB", from Hanbuch der Giebereitechnik, pp. 228-238.

*Primary Examiner*—Charles T. Jordan

*Assistant Examiner*—Daniel Wasil

*Attorney, Agent, or Firm*—Walter Ottesen

[57] ABSTRACT

The invention is directed to a container for transporting and/or storing irradiated nuclear fuel elements. The container includes a holding vessel made of cast iron containing nodular graphite and having an opening at one of its ends for receiving the materials to be stored therein and a cover for sealing the opening so as to be gas-tight with respect to the ambient. In order to weld a cover to the vessel without the necessity of conducting a follow-up heat treatment operation, an end ring made of cold-weldable material is mounted on the vessel at its opening. The end ring includes a connecting extension which is fused with the vessel when the latter is made by casting. After the vessel is filled, a cover made of a material having a structure similar to that of the end ring can be welded to the latter. In this way, a subsequent heat treatment of the vessel which would otherwise be necessary is avoided. The vessel and end ring can be viewed as being the vessel assembly and a method of making this assembly is also disclosed.

11 Claims, 3 Drawing Figures

CONTAINER FOR TRANSPORTING AND STORING NUCLEAR REACTOR FUEL ELEMENTS

FIELD OF THE INVENTION

The invention relates to a container for transporting and/or storing irradiated fuel elements wherein the vessel is made of cast iron containing nodular graphite. This cast iron is known as spherulitic-graphite cast iron and as nodular cast iron. The vessel has an opening at one of its ends for receiving the materials to be stored therein and the container includes a cover for sealing the opening in a gas-tight manner.

BACKGROUND OF THE INVENTION

The vessel of the fuel-element container has a thick-walled body made of nodular cast iron. A specific grade of this nodular cast iron which can be used is identified in German nodular cast iron specifications as GGG-40. Nodular cast iron is selected because of its especially high strength and toughness.

After the fuel element vessel is filled with irradiated nuclear reactor fuel elements, the vessel must be closed with a cover so as to be gas-tight with respect to the ambient. A tight closing of the metal container is possible by welding to it a metal cover.

However, if a cover is welded to a fuel-element vessel made of nodular cast iron, micro fissures can occur in the structure of the cast iron which can permit unwanted radioactive leakage to the ambient. To correct for such micro fissures, the container loaded with fuel elements must be subjected to a heat treatment in the temperature range of from 500° to 700° Centigrade. A heat treatment is generally not possible or only possible under very severe conditions since the fuel elements in the container must not be subjected to a temperature greater than 400° Centigrade. In addition, it would require a major engineering effort to subject the containers weighing approximately 100 tons to a heat treatment operation. It is for these reasons that the fuel-element containers made of nodular cast iron were previously closed with cover systems incorporating threads with seals interposed.

SUMMARY OF THE INVENTION

It is an object of the invention to provide a fuel element container of the type described above wherein the cover can be welded to the vessel after the latter has been filled without a subsequent heat treatment. It is a further object of the invention to provide a method of making the vessel assembly of such a container.

The container of the invention includes a nodular cast iron vessel having a base and a wall extending upwardly from the base. The wall has an upper end portion defining the opening of the vessel through which the fuel elements to be stored therein are passed. According to a feature of the invention, an end ring made of cold-weldable material is mounted on said upper end portion of the vessel. After the vessel has been filled, a sealing cover made of a material having a structure similar to that of the end ring can be cold welded to the vessel. A subsequent heat treatment of the vessel is thereby avoided.

As used herein, a cold-weldable material is defined as a material which can be welded without the necessity of conducting a follow-up heat treatment. In a material of this kind, no substantial stresses or structural changes occur during the welding operation which must be corrected by means of a subsequent heat treatment.

The end ring includes a connecting extension which is fused to the upper end portion of the wall of the vessel. The connecting extension is fused to and embedded in the upper end portion when the vessel is made by casting.

In an advantageous embodiment of the invention, the connecting extension of the end ring is provided with dove-tail projections. In this way, the end ring is securely anchored in the container vessel in a manner sufficient to withstand the highest requirements.

The vessel and end ring together can be viewed as being the vessel assembly of the container. A method of making this vessel assembly includes the step of arranging the end ring with respect to the part of the mold of the vessel that defines the upper end portion of the vessel wall in such a manner that the end ring itself defines a mold piece of the vessel mold, said end ring being disposed so that the connecting extension thereof extends down into the region of the vessel mold defining the upper end portion; and the step of pouring molten nodular cast iron into the vessel mold whereby the connecting extension becomes embedded in and fused to said vessel thereby tightly securing the end ring to the vessel.

In a further advantageous embodiment of the container of the invention, the end ring is configured to have an L-section wherein one leg constitutes the connecting extension fused into the upper end portion of the vessel wall and the other leg lies on the end face of the vessel wall. In this embodiment, a cover which can form a tight seal with the end ring is arranged on top the other leg and is cold-welded thereto.

In a still further embodiment of the container of the invention, the end ring is configured to have a step-like configuration when viewed in section. The end ring of the stepped section includes a downwardly extending lower leg connected to an upwardly extending upper leg by a horizontal step. The lower leg has a diameter smaller than that of the upper leg and defines the connecting extension when cast. The upper leg and the connecting step conjointly define a seat for a sealing cover. The sealing cover includes a base portion with an annular lip which extends upwardly therefrom in a direction perpendicular thereto. The end face of the lip and the upper end face of ring are cold-welded to each other.

It has been shown advantageous to make the end ring out of an alloyed cast iron containing nodular graphite. This can be explained in that the structural configuration of this material is similar to that of nodular cast iron of which the vessel is made. A material of this kind is GGG NiCr 20.2 which is commercially available in Germany under the tradename "Ni-Resist." Another advantageous material is steel.

Because of the invention it is now possible to tightly weld-seal containers having vessels made of nodular cast iron after such vessels are filled without the necessity of following up this welding operation with a heat treatment of the vessel.

BRIEF DESCRIPTION OF THE DRAWING

The invention will now be described with reference to the drawing wherein.

DESCRIPTION OF THE PREFERRED EMBODIMENTS OF THE INVENTION

Figure 1:
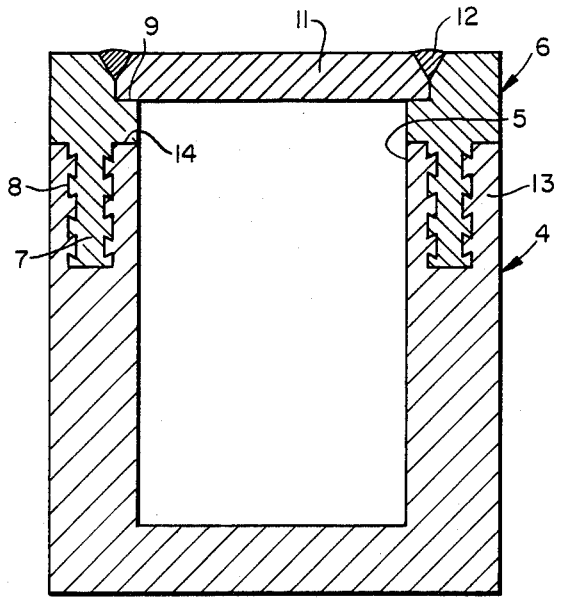
FIG. 1 is a side elevation view, in section, of a container according to the invention wherein the end ring includes a connecting extension having dove-tail projections formed thereon.

The fuel-element container shown in FIG. 1 includes a cylindrical vessel 4 consisting of GGG-40 nodular cast iron. The vessel 4 has a base and a wall extending upwardly from the base. The wall has an upper end portion 13 defining the opening 5 of the vessel for receiving the fuel elements (not shown) to be stored in the container. An end ring 6 is arranged at the upper end portion 13 of the vessel 4 and lies on the end face 14 of the wall of the vessel 4. The end ring 6 defines a longitudinal axis and includes an integral connecting extension 7 extending downwardly in the direction of said axis. As seen in FIG. 1, the connecting extension 7 is fully embedded in the upper end portion 13 of the wall of the vessel 4. The connecting extension 7, like the ring of which it forms an integral part, is of annular configuration and includes a plurality of dove-tail projections 8.

During the operation for producing the vessel 4, the end ring 6 is placed in the casting mold so that it constitutes a mold piece thereof. After the cast iron melt is poured into the mold, the connecting extension 7 is joined to the vessel 4 by fusion which occurs at its surface. The end ring 6 and the vessel 4 are thereby tightly joined to each other. The connecting extension 7 and its fusion to the vessel 4 are exemplary of connecting means for fixedly connecting the end ring to the upper end portion of the vessel.

The end ring 6 has an inner stepped recess 9 in which the sealing cover 11 is placed. The sealing cover 11 is made of the same material as the end ring 6 and is cold-welded to the end ring 6 whereby a welding seam 12 is formed. The fuel element container is thereby sealed so as to be gas tight with respect to the ambient. A subsequent heat treatment of the fuel element container is now unnecessary since the vessel 4 was not welded.

Figure 2:
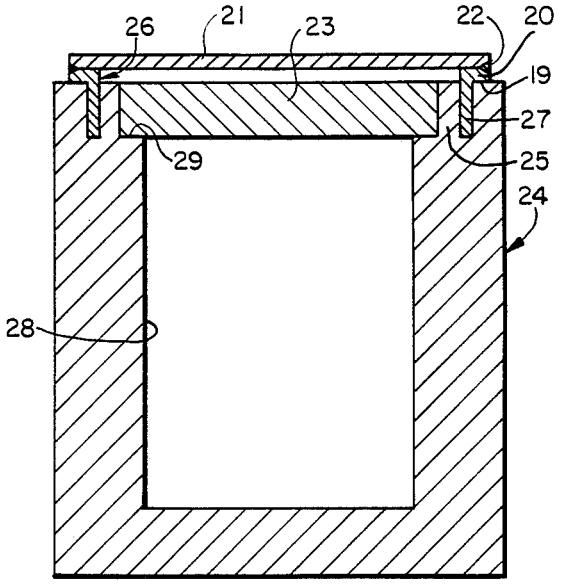
FIG. 2 is a side elevation view, in section, of another embodiment of the container according to the invention wherein the end ring has an L-shaped section.

FIG. 2 shows another embodiment of the invention wherein the end ring 26 is configured so as to have an L-shaped section. A first leg of the end ring 26 constitutes the connecting extension 27 which, as in the embodiment of FIG. 1, is joined to the vessel 24. The second leg 20 of the ring 26 lies on the end face 19 of the wall of the vessel 24 of the container. The upper end portion 25 of the vessel wall is provided with an annular inner stepped recess 29 wherein a cover 23 can be inserted. The cover 23 can be threaded and include a seal (not shown) interposed between the cover and the vessel. A tight sealing cover 21 lies on the end ring 26 and is cold-welded about is periphery to the end ring 26 whereby the welding seam 22 is formed.

Figure 3:
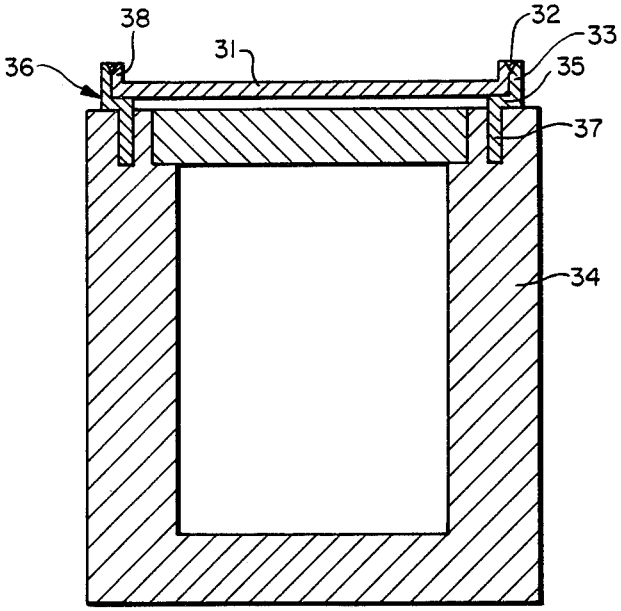
FIG. 3 is a side elevation view, also in section, of a still further embodiment of the container of the invention wherein the end ring is of a stepped section.

The embodiment of the end ring shown in FIG. 3 differs from those end rings shown in FIGS. 1 and 2 in that the end ring 36 has a stepped configuration when viewed in section. The section view shows a downwardly extending lower leg 37 connected to an upwardly extending upper leg 33 by an annular horizontal step 35. The annular lower leg 37 has an inner diameter smaller than that of the annular upper leg 33 and defines the connecting extension when the vessel 34 is cast. The upper leg 33 and connecting step 35 conjointly define the seat for sealing cover 31. The sealing cover 31 includes an annular upwardly extending lip 38. The respective peripheral edges of the lip 38 and end ring 36 are cold-welded to each other whereby a weld seam 32 is formed. This embodiment affords the special advantage that the integrity of the weld seam 32 can be inspected by conventional testing apparatus.

Other modifications and variations to the embodiments described will now be apparent to those skilled in the art. Accordingly, the aforesaid embodiments are not to be construed as limiting the breadth of the invention. The full scope and extent of the present contribution can only be appreciated in view of the appended claims.

We claim:

1. A container for transporting and storing irradiated nuclear reactor fuel elements, the container comprising:
   - a vessel made of nodular cast iron, the vessel having a base and a wall extending upwardly from said base, said wall having an upper end portion defining the opening of the vessel through which the fuel elements to be stored therein are passed;
   - an end ring mounted on said upper end portion, said end ring having a connecting extension cast-embedded into said upper end portion whereby said end ring is securely mounted to said vessel;
   - a sealing cover weldable to said end ring for sealing the container; and,
   - said end ring and said cover each being made of a material whereby said end ring upon being welded to said cover results in an effective gas-tight seal of said cover to said vessel without the necessity of subjecting said cover and said vessel to a follow-up heat treatment to remove unwanted microfissures from the weld.

2. The container of claim 1, said connecting extension having a plurality of dove-tail projections formed thereon.

3. The container of claim 1, said end ring being configured as an annular body having an L-shaped section, one of the legs of said ring defining said connecting extension fused into said upper end portion and the other one of said legs lying flat on the end face of said wall of said vessel, said cover being configured to form a tight fit with said end ring and being welded thereto.

4. The container of claim 1, said end ring being configured as an annular body having a stepped section, the stepped section being defined by a downwardly extending annular inner leg connected by a horizontal annular step to an upwardly extending annular outer leg, said inner leg defining said connecting extension fused into said upper end portion, said step and said outer leg conjointly defining a seat for said cover, said cover having a peripheral lip perpendicular to the main body of the cover, said peripheral lip and said outer leg having respective peripheral edges, said peripheral edges being juxtaposed when said cover is placed in said seat and being welded to each other.

5. The container of claims 1, 2, 3 or 4, said end ring being made of alloyed nodular cast iron.

6. The container of claims 1, 2, 3 or 4, said end ring being made of steel.

7. A container for transporting and storing irradiated nuclear reactor fuel elements, the container comprising:
   - a vessel made of nodular cast iron, the vessel having a base and a wall extending upwardly from said base, said wall having an upper end portion defining the opening of the vessel through which the fuel elements to be stored therein are passed;

an end ring mounted on said upper end portion and made of a material selected from the group consisting of alloyed nodular cast iron and steel; said end ring including connecting means cast-embedded in said upper end portion for fixedly connecting said end ring to said upper end portion; and, a cover for sealing the container so as to be gas tight with respect to the ambient, said cover likewise being made of a material selected from the group consisting of alloyed nodular cast iron and steel whereby said cover upon being welded to said end ring results in an effective gas-tight seal of said cover to said vessel without the necessity of subjecting said cover and said vessel to a follow-up heat treatment to remove unwanted microfissures from the weld.

8. The container of claim 7, said connecting means being a projection formed on said end ring and fused to said upper end portion of said vessel thereby tightly anchoring the end ring thereto.

9. The container of claim 8, said projection being an annular projection extending downwardly from the main body of said end ring into said upper end portion and being embedded therein.

10. The container of claims 7, 8 or 9, said end ring being made of alloyed nodular cast iron.

11. The container of claims 7, 8 or 9, said end ring being made of steel.

* * * * *

UNITED STATES PATENT AND TRADEMARK OFFICE

CERTIFICATE OF CORRECTION

PATENT NO. : 4,567,014

DATED : January 28, 1986

INVENTOR(S) : Franz-Wolfgang Popp and Kurt Feuring

It is certified that error appears in the above-identified patent and that said Letters Patent is hereby corrected as shown below:

On the cover sheet of the patent, under the heading "OTHER PUBLICATIONS": please delete "Article entitled "Verband Von Stahl, Metallen BZW, Deren Legierungen Mit FE-C-GUB", from Hanbuch der Giebereitechnik, pp. 228-238." and substitute -- Article entitled "Verbund von Stahl, Metallen bzw. deren Legierungen mit Fe-C-Guß", from Handbuch der Gießereitechnik, pp. 228-238. -- therefor.

In column 2, line 33: add -- of -- after the word "top".

In column 2, line 47: add -- the -- after the word "of".

In column 3, line 58: delete "about is" and substitute -- about its -- therefor.

Signed and Sealed this

*Eighth* Day of *July 1986*

[SEAL]

*Attest:*

DONALD J. QUIGG

*Attesting Officer*

*Commissioner of Patents and Trademarks*